US008870187B2

(12) United States Patent
Murray

(10) Patent No.: US 8,870,187 B2
(45) Date of Patent: Oct. 28, 2014

(54) SHAFT SEAL FOR DOWN-HOLE TOOLS

(76) Inventor: Mark Murray, Aberdeen (GB)

( * ) Notice: Subject to any disclaimer, the term of this patent is extended or adjusted under 35 U.S.C. 154(b) by 885 days.

(21) Appl. No.: 12/680,443

(22) PCT Filed: Oct. 3, 2008

(86) PCT No.: PCT/GB2008/050895

§ 371 (c)(1),
(2), (4) Date: Nov. 1, 2010

(87) PCT Pub. No.: WO2009/047552

PCT Pub. Date: Apr. 16, 2009

(65) Prior Publication Data

US 2011/0037231 A1 Feb. 17, 2011

(30) Foreign Application Priority Data

Oct. 10, 2007 (GB) ..... 0719764.3
Sep. 9, 2008 (GB) ..... 0816471.7

(51) Int. Cl.

| | |
|---|---|
| ***E21B 33/128*** | (2006.01) |
| ***F16J 15/18*** | (2006.01) |
| ***E21B 33/12*** | (2006.01) |
| ***F16J 15/16*** | (2006.01) |
| ***E21B 4/00*** | (2006.01) |

(52) U.S. Cl.

CPC ..... *E21B 4/003* (2013.01)
USPC ..... 277/342; 277/337; 277/510; 166/179

(58) Field of Classification Search

USPC ..... 277/238, 329, 337, 338, 342, 510, 511; 166/84.1, 107, 179

See application file for complete search history.

(56) References Cited

U.S. PATENT DOCUMENTS

| | | | | |
|---|---|---|---|---|
| 3,365,202 | A | 1/1968 | Carleton et al. | |
| 3,666,333 | A | 5/1972 | Dicky et al. | |
| 4,078,832 | A * | 3/1978 | Wittman | 285/18 |
| 4,239,266 | A * | 12/1980 | Mynhier | 285/323 |
| 4,340,204 | A * | 7/1982 | Herd | 251/327 |
| 4,381,868 | A * | 5/1983 | Croy et al. | 277/328 |
| 4,513,816 | A * | 4/1985 | Hubert | 166/75.11 |
| 5,195,754 | A | 3/1993 | Dietle | |
| 5,639,227 | A | 6/1997 | Mills | |

FOREIGN PATENT DOCUMENTS

| | | |
|---|---|---|
| DE | 2030117 | 1/1971 |
| WO | 2006/048629 | 5/2006 |

* cited by examiner

*Primary Examiner* — Vishal Patel
*Assistant Examiner* — Nicholas L Foster
(74) *Attorney, Agent, or Firm* — Dickinson Wright PLLC

(57) ABSTRACT

A sealing apparatus for a downhole tool having a movable member (11) which moves relative to a housing, the sealing apparatus comprising: at least one sealing member having (10A) a first position in which the sealing member is spaced from the movable member and a second position in which the sealing member (10B) is in contact with the movable member (IB) to provide a sealing barrier; and switching means for switching the sealing member between the first and second positions.

6 Claims, 1 Drawing Sheet

SHAFT SEAL FOR DOWN-HOLE TOOLS

CROSS REFERENCE TO RELATED APPLICATIONS

The present application is a 35 U.S.C. §371 national stage filing of International Patent Application No. PCT/GB2008/050895, filed Oct. 3, 2008, and through which priority is claimed to Great Britain Patent Applications No. 0719764.3, filed Oct. 10, 2007, and No. 0816471.7, filed Sep. 9, 2008, the disclosures of which are incorporated herein by reference in their entireties.

STATEMENT REGARDING FEDERALLY SPONSORED RESEARCH OR DEVELOPMENT

Not Applicable.

THE NAMES OF THE PARTIES TO A JOINT RESEARCH AGREEMENT

Not Applicable.

FIELD OF THE INVENTION

This invention relates to downhole tools, and a sealing arrangement for such tools. In particularly, but not exclusively, the invention relates to downhole tools which have a rotary or reciprocating shaft for use in oil and water/gas well applications and which comprise a seal assembly.

BACKGROUND OF THE INVENTION

Sealing arrangements for downhole tools which have a component which moves relative to a housing, for example rotary or reciprocating shafts, are known in the industry. A typical example is described in U.S. Pat. No. 5,639,227, Seal arrangement for the drivehead of a downhole rotary pump.

One limitation of the current state of the art is that these rotary or reciprocating seals can wear out, due to the fact that the surface of the seal is in continuous contact with the shaft. That is, the seal is continually energised or engaged, with an engagement force between the seal surface and the shaft surface. Various surface treatments, lubricants and surface finishes all help to reduce the wear of the seal, extending the useful life of the product, but only to a limited extent. In certain applications, the necessity of the seal to perform a sealing function in a downhole tool may be only a proportion of the time the tool is in operation. In the case of the rotary or reciprocating shaft seal, the duty period may only be 5% of the operational time. However, with the current state of the art the seal will be in contact with the shaft 100% of the time, leading to limited operational life.

BRIEF SUMMARY OF THE INVENTION

According to a first aspect of the present invention there is provided a sealing apparatus for a downhole tool having a movable member which moves relative to a housing, the sealing apparatus comprising:

- at least one sealing member having a first position in which the sealing member is spaced from the movable member and a second position in which the sealing member is in contact with the movable member to provide a sealing barrier; and
- switching means for switching the sealing member between the first and second positions.

Preferably the switching means comprises mechanical or hydraulic means. Preferably the sealing apparatus includes biasing means for biasing the sealing member towards the second position. Preferably the switching means comprises means for urging the sealing member towards the first position against the action of the biasing means. The sealing apparatus therefore uses a hold-off mechanism to prevent the seal surface contacting the moving surface of the shaft.

The sealing apparatus may include a fail-safe feature, in that when the activation load is removed, the sealing function is activated.

Alternatively, the sealing apparatus may include biasing means for biasing the sealing member towards the first position. The switching means may comprise means for urging the sealing member towards the second position against the action of the biasing means.

Preferably, the biasing means comprises a compression spring.

Preferably, the sealing member comprises a plurality of seal rings, which may be of the same or different material, and, which when axially compressed, form a seal on the shaft.

Preferably, the sealing member includes a seal housing which acts as a piston when pressure is applied to the seal housing, to increase the compressive force on the seal rings. Preferably the pressure is applied to the seal housing from below.

According to a second aspect of the present invention there is provided a downhole tool including a sealing apparatus in accordance with the first aspect of the invention.

BRIEF DESCRIPTION OF THE SEVERAL VIEWS OF THE DRAWINGS

A particular embodiment of the invention will now be described by way of example only with reference to the accompanying drawing in which.

DETAILED DESCRIPTION OF THE INVENTION

Figure 1A:
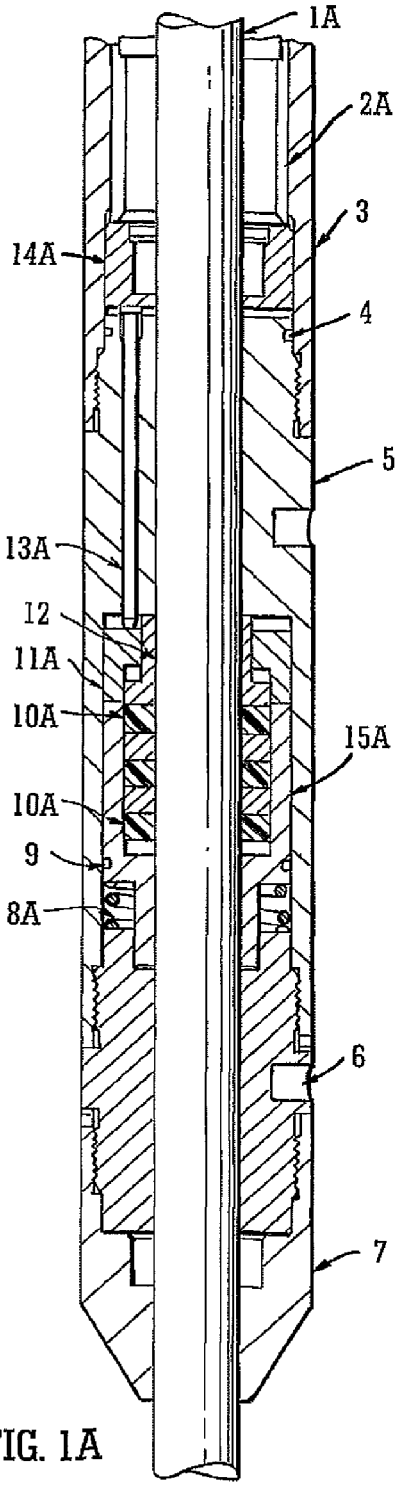
FIG. 1A shows the shaft and activation method with the seals disengaged.
Figure 1B:
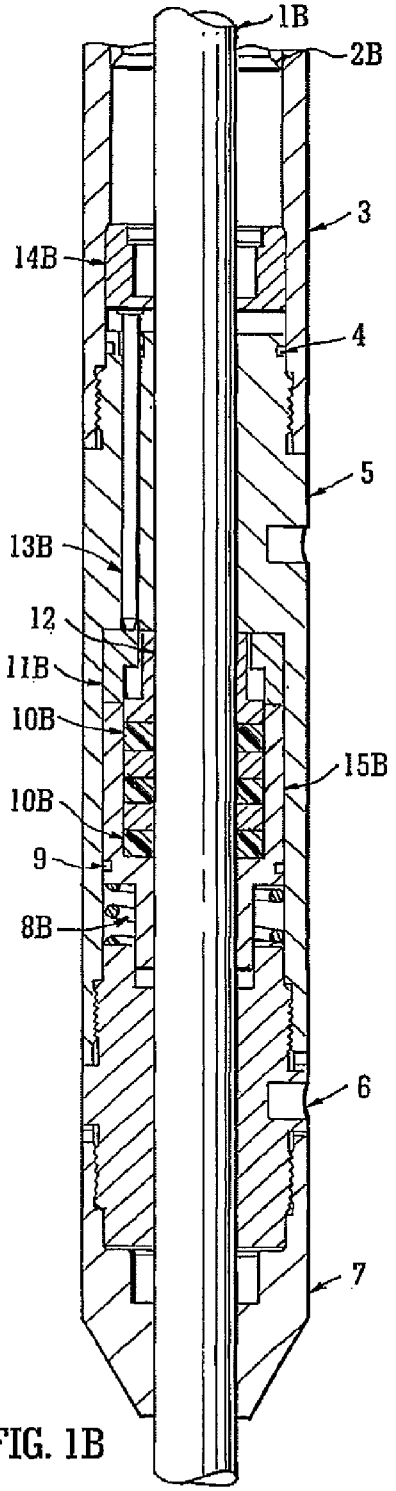
FIG. 1B shows the shaft and activation method with the seals engaged.

In the preferred embodiment of the invention, a movable member or shaft 1A is held within a down-hole tool. For the purposes of this application, this tool may be a safety valve as described in PCTGB2005/004216, however the invention is applicable to other down-hole tools. The activation sleeve 2A is held within a housing 3, which is connected to the down-hole tool. A rod housing 5 is connected to the housing 3 and in turn a retainer housing 6 and end cap 7 make up the main external structure of the sealing apparatus.

The activation sleeve 2A is urged downwards by the operation of the downhole tool, via hydraulic or mechanical force. The activation sleeve, while part of the downhole tool, is used to operate the seal. Preferably, the activation sleeve is moved downwards by hydraulic pressure from the surface via a hydraulic control line. The hydraulic line acts on a piston, where the piston seals are so configured as to provide axial movement downwards of the activation sleeve. The activation sleeve may be moved in the opposite direction by a spring, or by another hydraulic piston, biased to axially move the activation sleeve upwards.

The activation sleeve contacts a ring 14A, which in turn contacts a push rod 13A. The push rod 13A contacts a further ring 11A, which is held against a seal housing 15A by the action of biasing means or a spring 8A. With the ring 11A and seal housing 15A urged down by the activation sleeve 2A, the axial gap for the flexible seal rings 10A between the seal housing 15A and seal retaining ring 12 is such that the seal rings do not contact the moving shaft 1A. The components which cause the seal rings to be spaced from the moving shaft 1A form switching means.

The seal ring 10A may be an elastomeric or non-elastomeric material commercially available for many suppliers. The invention may have one or more seal rings of various materials, which form an effective seal once compressed onto the shaft 1B. Seals 4 and 9 form the remainder of the sealing system. These seals 4 and 9 are preferably o-rings, but other seal types are also suitable.

When it is wished to make the seal between the shaft and housing, most likely when the shaft is stationary, the activation sleeve 2B is moved away from the ring 14B. As the activation sleeve 2B is removed, the spring 8B urges the seal housing 15B, ring 11B, push rod 13B against the ring 14B. This reduces the axial gap between the seal housing 15*b* and the seal retaining ring 12, hence compressing the seal rings 10B. When the seal rings 1B are compressed, pressure differential from below the tool acts across a piston area defined by the seal 9 and the seal ring 10B. This pressure acts on the piston to boost the compressive force on the seal rings 10B, increasing the contact pressure on the shaft 1B and hence increasing the sealing capability.

It can be seen that the sealing mechanism may be activated, de-activated and re-activated a multitude of times, depending on the efficacy of the seal rings 10.

It can be seen to those skilled in the art that various changes may be made to the features within these embodiments, without departing from the scope of the invention.

The invention claimed is:

1. A sealing apparatus for a down hole tool having a housing, the sealing apparatus comprising:

a movable member which is movable relative to the housing;

at least one sealing member having a first position in which the sealing member is spaced from the movable member and a second position in which the sealing member is in contact with the movable member to provide a sealing barrier;

an activation sleeve; and a switching mechanism for switching the sealing member between the first and second positions, wherein the switching mechanism facilitates moving the activation sleeve by at least one of mechanical and hydraulic force to move the sealing member to the first position and, in the absence of the hydraulic or mechanical force, automatically moves the activation sleeve in the opposite direction under the action of a biasing member for biasing the sealing member towards the second position.

2. A sealing apparatus as claimed in claim 1, wherein the biasing member comprises a compression spring.

3. A sealing apparatus as claimed in claim 1, wherein the sealing member comprises a plurality of seal rings which, when axially compressed by action of the activation sleeve and the biasing member, provide the sealing barrier.

4. A sealing apparatus as claimed in claim 1, wherein the sealing member includes a seal housing which acts as a piston when pressure is applied to the seal housing to increase the compressive force on the seal rings.

5. A sealing apparatus as claimed in claim 4, wherein a pressure differential from below acts across the piston defined by the seal housing and seal rings and increases the compressive force on the seal rings.

6. A downhole tool, comprising a movable member which moves relative to a housing, wherein within the housing an activation sleeve is included, at least one sealing member having a first position in which the sealing member is spaced from the movable member and a second position in which the sealing member is in contact with the movable member to provide a sealing barrier, and a switching mechanism for switching the sealing member between the first and second positions, wherein the switching mechanism facilitates moving the activation sleeve by at least one of mechanical and hydraulic force to move the sealing member to the first position and, in the absence of the hydraulic or mechanical force, automatically moves the activation sleeve in the opposite direction under the action of a biasing member for biasing the sealing member towards the second position.

* * * * *